US007377879B1

(12) United States Patent
Chen

(10) Patent No.: US 7,377,879 B1
(45) Date of Patent: May 27, 2008

(54) PEDAL ADJUSTABLE SYSTEM FOR EXERCISERS

(75) Inventor: Ming Nan Chen, Taichung (TW)

(73) Assignee: Michael Lin, Chong San Chu, Taipei (TW)

( * ) Notice: Subject to any disclaimer, the term of this patent is extended or adjusted under 35 U.S.C. 154(b) by 0 days.

(21) Appl. No.: 11/705,959

(22) Filed: Feb. 14, 2007

(51) Int. Cl.
*A63B 22/00* (2006.01)

(52) U.S. Cl. ..... 482/51; 482/52; 482/62; 482/70; 482/79; 482/139; 482/908

(58) Field of Classification Search ..... 482/51, 482/52, 57, 62, 79, 80, 139, 908; 74/512, 74/594.4, 594.7
See application file for complete search history.

(56) References Cited

U.S. PATENT DOCUMENTS 4,573,678 A * 3/1986 Lamb et al. ..... 482/80
5,069,445 A * 12/1991 Mai ..... 482/80
5,503,607 A * 4/1996 Lo ..... 482/52
6,390,954 B1 * 5/2002 Lee ..... 482/52
6,500,096 B1 * 12/2002 Farney ..... 482/52
7,037,242 B2 * 5/2006 Lo et al. ..... 482/52
7,244,218 B1 * 7/2007 Lin et al. ..... 482/52
7,300,387 B2 * 11/2007 Wang ..... 482/52
2006/0046902 A1 * 3/2006 Chang ..... 482/52
2006/0172865 A1 * 8/2006 Dey et al. ..... 482/52

* cited by examiner

*Primary Examiner*—Terrell Mckinnon
*Assistant Examiner*—Andrew M Tecco
(74) *Attorney, Agent, or Firm*—Charles E. Baxley

(57) ABSTRACT

A pedal adjustable system for an exerciser includes a casing composed of an end member and two side plates connected on two ends of the end member. An adjusting unit is received in the casing and has a threaded rod which can be rotated to move the adjusting unit. The tubular body has two side portions which are movably engaged with two slots in the two side plates. Two pivotal plates each have an end connected to the side portion corresponding thereto and the other end of each of the two pivotal plates is pivotably connected to a pivotable unit on which a pedal is connected. The inclination of the pedal can be adjusted by the user to rotate the threaded rod to pivot the pivotal plates together with the pedal.

12 Claims, 7 Drawing Sheets

PEDAL ADJUSTABLE SYSTEM FOR EXERCISERS

FIELD OF THE INVENTION

The present invention relates to a pedal adjustable system for exerciser and the pedal can be adjusted when needed.

BACKGROUND OF THE INVENTION

Some exercisers have pedals and the pedals each have a recessed area so that the user's feet can be accommodated in the recessed area. During operation of the exerciser such as the elliptical trainer, the user has to alternatively operate the pedals and the swing arms. The pedals are moved along an elliptical path. This means the user's feet have to adjust the muscles at different positions on the elliptical path. For a tall user, the angle between the foot and the shank is larger than that of a short user. The conventional pedals are fixed to the exerciser and the angle of the pedal cannot be adjusted so that the taller user and the shorter user might not be satisfied with the fixed-angle pedals. Although some exercisers include pivotable pedals which are pivotable during operation, the inclination of the pedals is not adjustable when the pedals are not in operation status.

The present invention intends to provide a pedal adjustable system for exercisers wherein the pedal is connected with a bottom board which can be pivoted by an adjusting unit so as to adjust the inclination of the pedal.

SUMMARY OF THE INVENTION

The present invention relates to a pedal adjustable system which comprises a casing having an end member and two side plates which are connected on two ends of the end member. An adjusting unit has a tubular body which has a nut connected to an end thereof, and a threaded rod threadedly extends through the tubular body and the nut. The tubular body has two side portions which are movably engaged with two slots defined through the two side plates, so that when rotating the threaded rod, the tubular body is moved along the slots. Two pivotal plates each have an end connected to the side portion corresponding thereto and the other end of each pivotal plate is pivotably connected to a pivotable unit. A pedal is connected on the pivotable unit.

The primary object of the present invention is to provide a pedal adjustable system for an exerciser and the inclination of the pedal can be easily adjusted by the user by rotating a knob.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
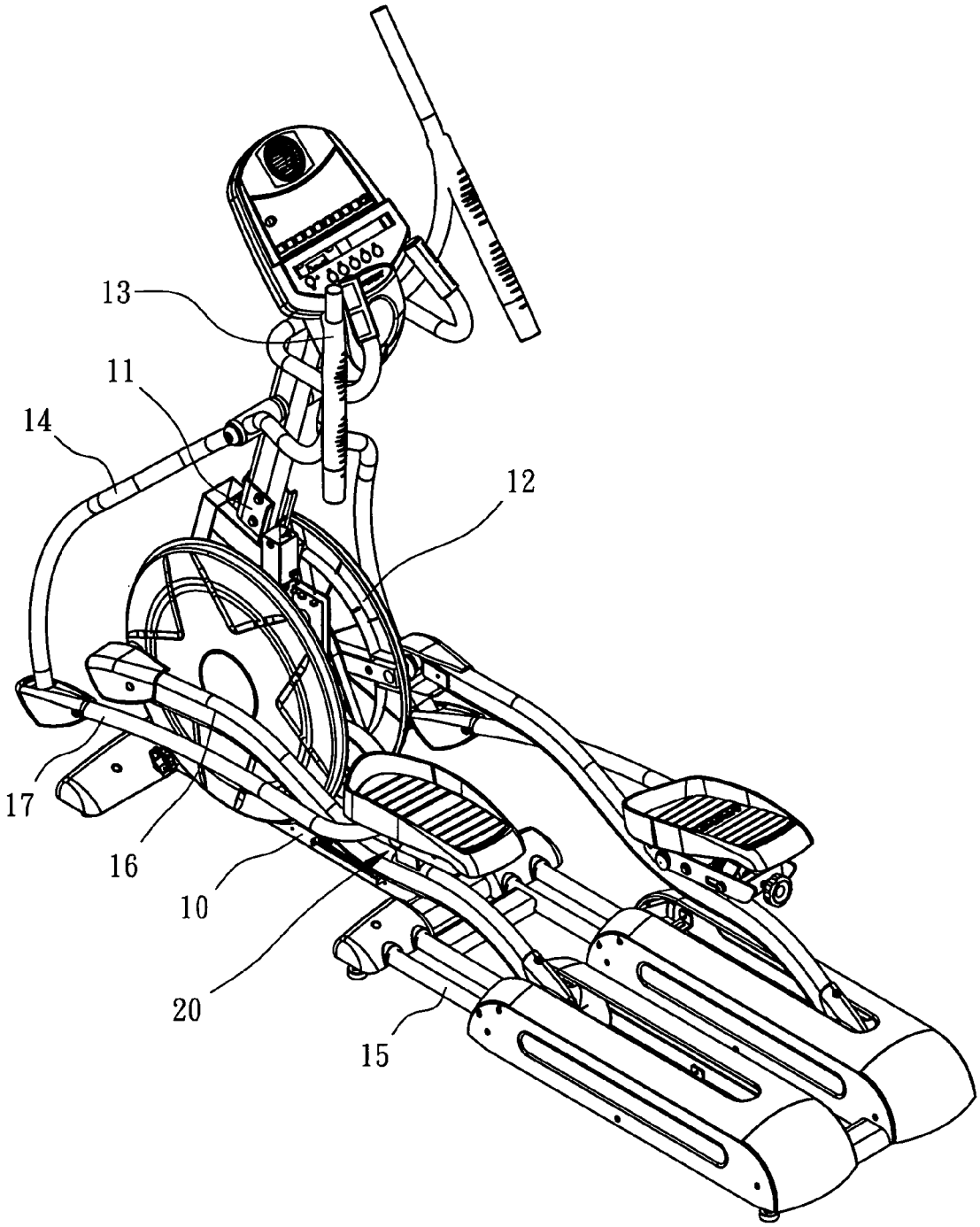
FIG. 1 is a perspective view to show an exerciser with the pedal adjustable system of the present invention.
Figure 2:
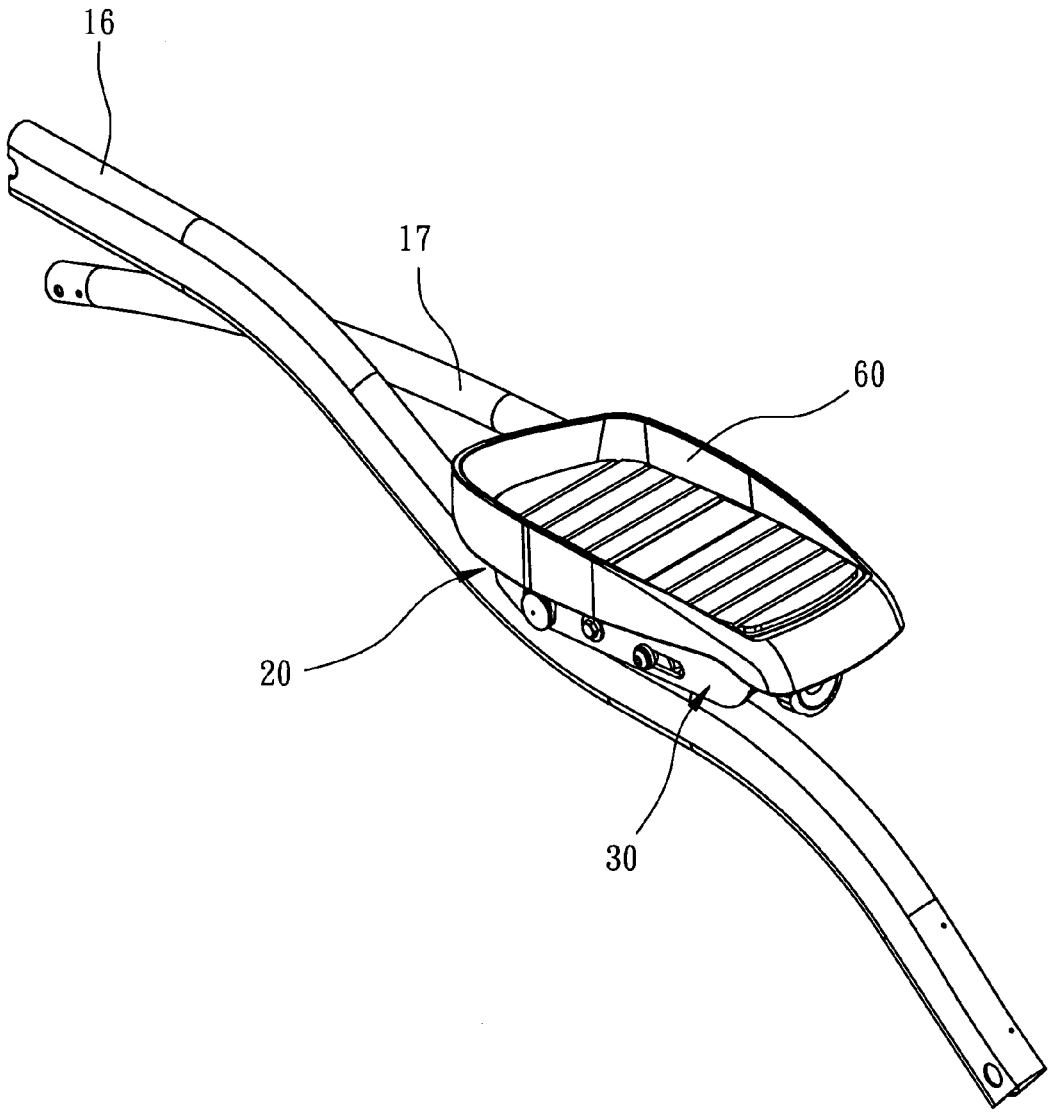
FIG. 2 shows the pedal is connected on the pivotable unit.
Figure 3:
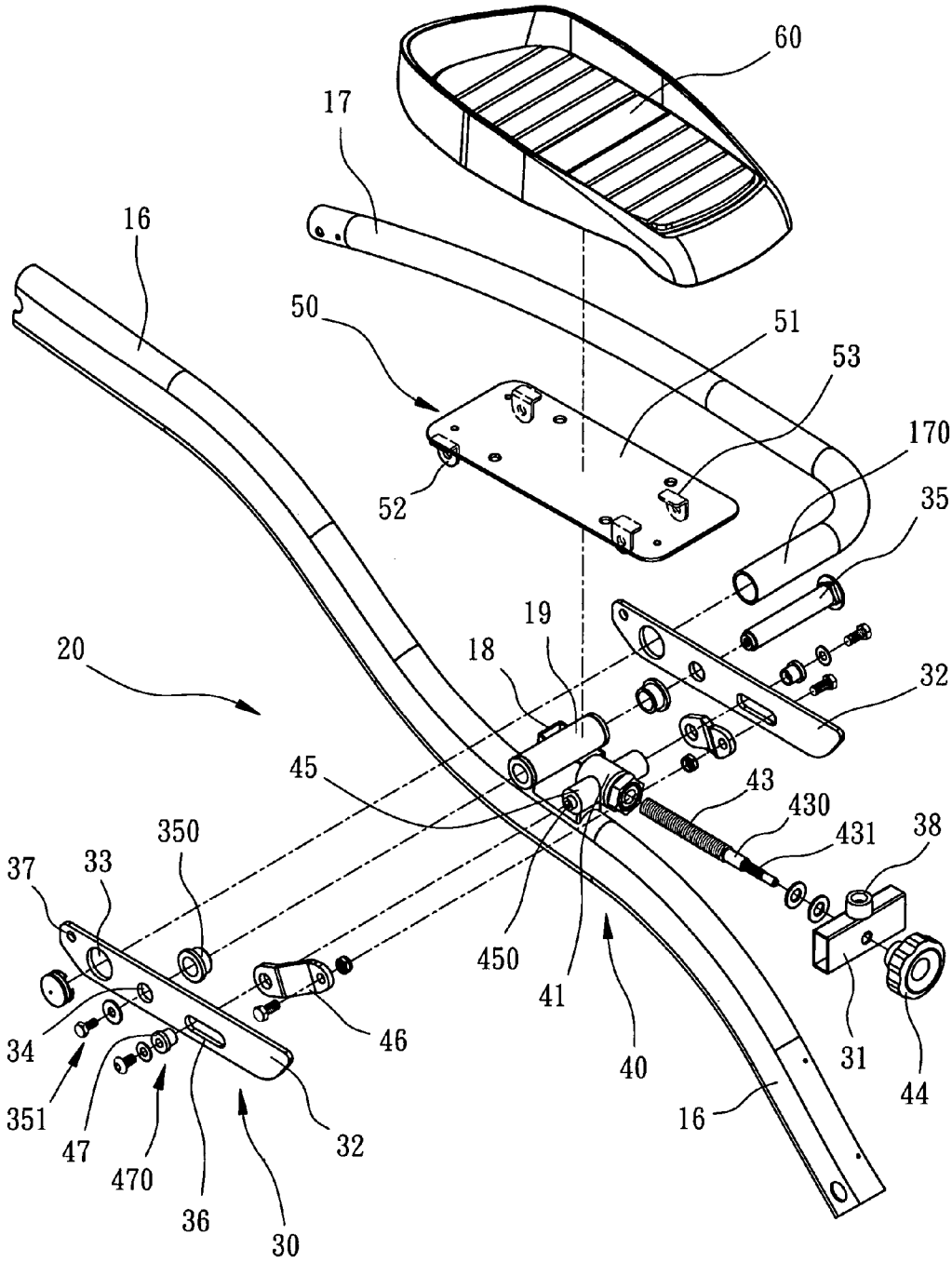
FIG. 3 is an exploded view to show the pedal adjustable system of the present invention.
Figure 4:
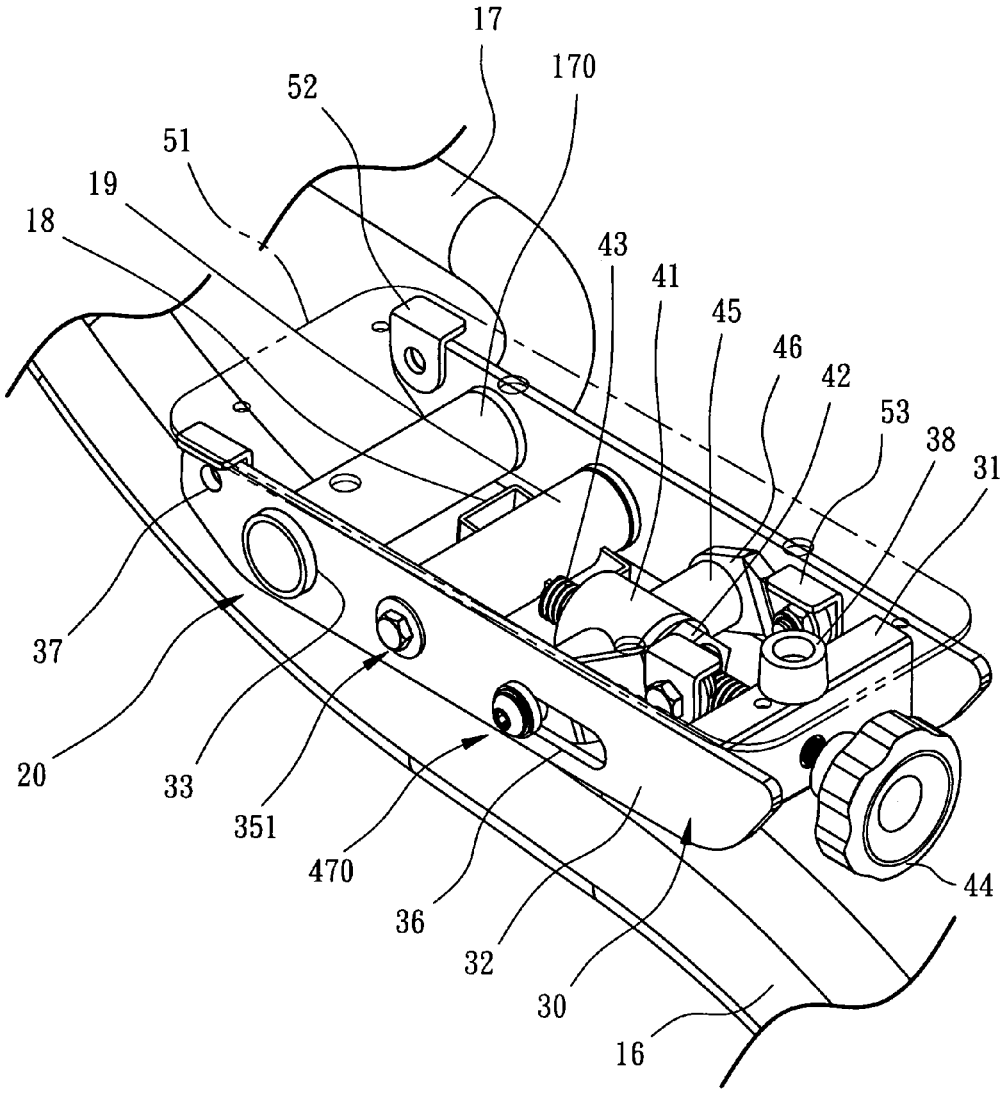
FIG. 4 shows the contents in the casing of the pedal adjustable system of the present invention.
Figure 5:
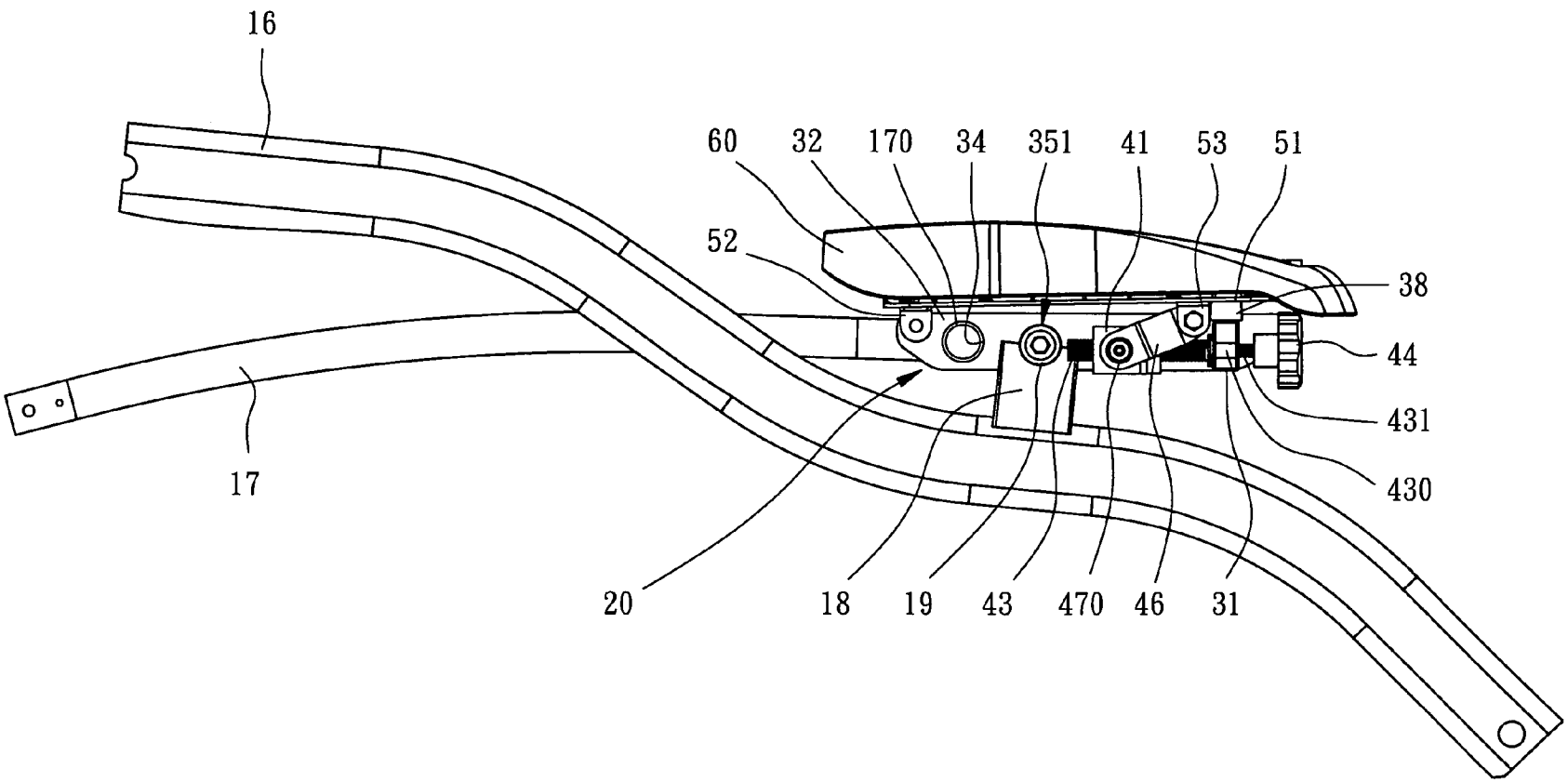
FIG. 5 shows that the pivotal plate is positioned at a first position.

Referring to FIGS. 1 to 4, the exerciser with the pedal adjustable system of the present invention comprises a base 10 having an upright frame 11 on a front end thereof and two handles 13 and swing arms 14 are pivotably connected on two sides of the upright frame 11. A fly wheel 12 is located between the base 10 and the upright frame 11 and two rail units 15 are connected to a rear end of the base 10. Two links 16 are connected between the fly wheel 12 and the rail units 15. The links 16 are connected to two pedal units 20 and can be movable alternatively. Each link 16 has a connection member 18 at a mediate portion thereof and the connection member 18 has a tube 19. The two side plates 32 of the casing 30 each have a hole 34. A pin 35 extends through the tube 19 and are connected with two end members 350 on two ends thereof. The two end members 350 are connected to the two respective holes 34 by two locking members 351.

Each pedal unit 20 has a casing 30 having an end member 31 and two side plates 32 which are connected on two ends of the end member 31. Each of the two side plates 32 has a slot 36 defined therethrough. Two respective connection rods 17 are connected between the two pedal units 20 and two respective lower ends of the two swing arms 14. Each connection rod 17 has a connection section 170 which extends through a hole 33 defined in each of the two side plates 32.

An adjusting unit 40 is received in the casing 30 and has a tubular body 41 which has a nut 42 connected to an end thereof, and a threaded rod 43 threadedly extends through the tubular body 41 and the nut 42. The tubular body 41 has two side portions 45 which are movably engaged with the two slots 36 of the two side plates 32. The threaded rod 43 of the adjusting unit 40 has a plain section 430 which is connected to the end member 31, and a threaded section 431 which extends out from the end member 31. A knob 44 is threadedly connected to the threaded section 431. The end member 31 has a rubber piece 38 on a top thereof so as to absorb shocks when the pedal 60 contacts the end member 31.

Two pivotal plates 46 each have an end connected to the side portion 45 corresponding thereto. Each of the side portions 45 has a protrusion 450 extending axially from a distal end thereof, the protrusions 450 extend through an end of each the pivotal plates 46 and the slots 36 and are connected with an end cap 47. The end caps 47 are fixed to the protrusions 450 by two locking members 470 so that the two end caps 47 are movable in the slots 36.

A pivotable unit 50 includes a bottom board 51 which has two first lugs 52 extending from an underside of the first end thereof and two second lugs 53 extend from the underside of the second end of the bottom board 51. The two side plates 36 each have a pivot hole 37 and the first lugs 52 are connected with the pivot holes 37 of the two side plates 36. The second lugs 53 are pivotably connected with the pivotal plates 46. A pedal 60 is connected on the pivotable unit 50.

Figure 6:
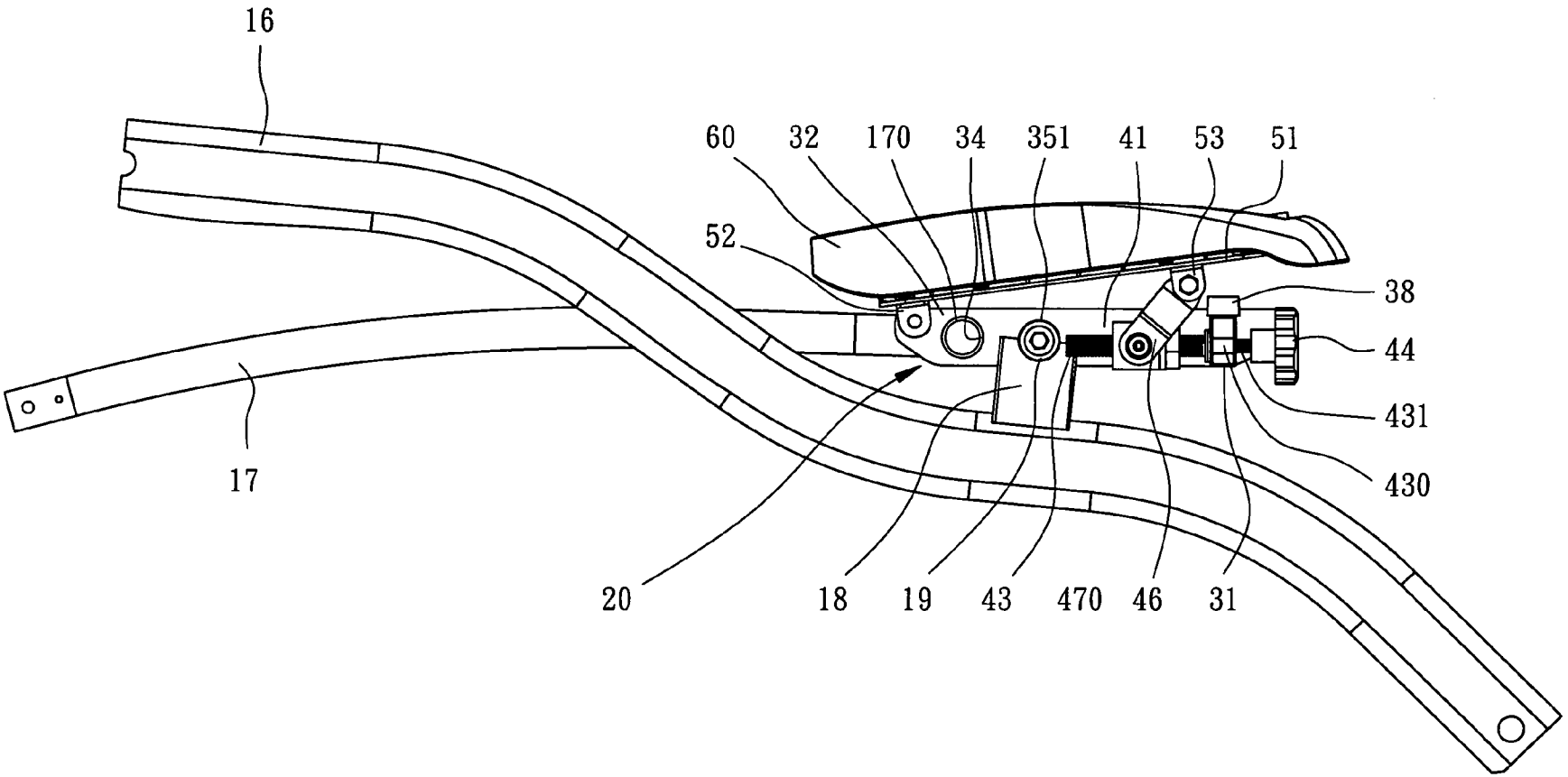
FIG. 6 shows that the pivotal plate is positioned at a second position.
Figure 7:
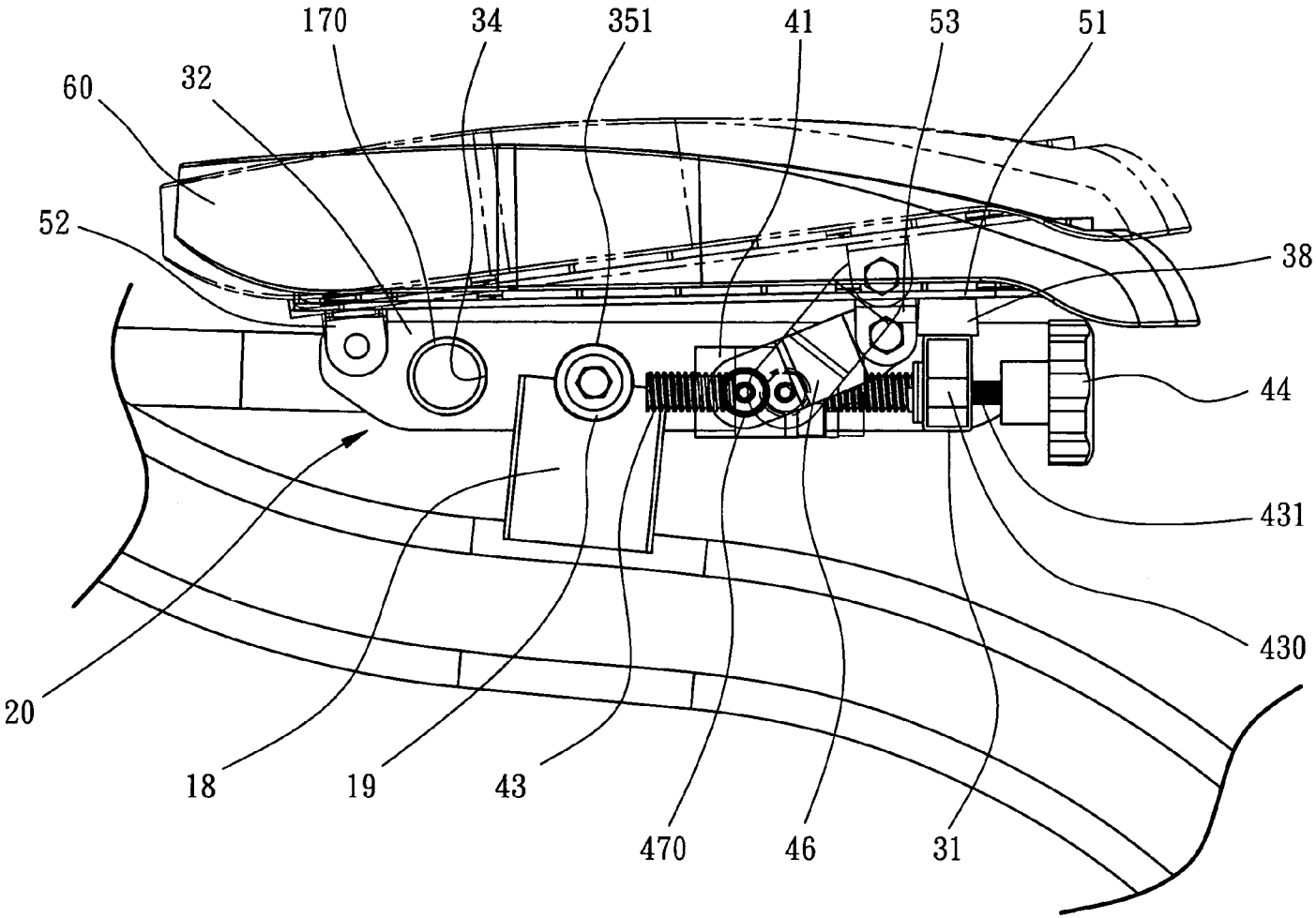
FIG. 7 shows the adjustment of the pedal by rotating the threaded rod.

When rotating the knob 44, the tubular body 41 moves along the threaded rod 43. As shown in FIGS. 4 to 7, when the tubular body 41 moves toward the connection member 18, the angle between the pivotal plates 46 and the threaded rod 43 is smaller so that the pedal 60 is positioned in horizontal orientation. On the contrary, when moving the tubular body 41 away from the connection member 18, the pivotal plates 46 are pivoted upright so that the second end of bottom board 51 is lifted so that the pedal 60 is orientated as shown in FIG. 6.

The adjustment is convenient and easy for users who simply rotate the knob 44 to move the tubular body 41 to obtain a desired inclination of the pedals 60.

While we have shown and described the embodiment in accordance with the present invention, it should be clear to those skilled in the art that further embodiments may be made without departing from the scope of the present invention.

What is claimed is:

1. A pedal adjustable system comprising:

a casing having an end member and two side plates which are connected on two ends of the end member, each of the two side plates having a slot defined therethrough;

an adjusting unit having a tubular body which has a nut connected to an end thereof, a threaded rod threadedly extending through the tubular body and the nut, the tubular body having two side portions which are movably engaged with the two slots of the two side plates, two pivotal plates each having an end connected to the side portion corresponding thereto;

a pivotable unit having a first end pivotably connected to the two side plats and a second end of the pivotable unit pivotably connected to the two pivotal plates, and a pedal connected on the pivotable unit.

2. The system as claimed in claim 1, wherein the pivotable unit includes a bottom board which has two first lugs extending from an underside of the first end thereof and two second lugs extend from the underside of the second end of the bottom board, the two side plates each have a pivot hole and the first lugs are connected with the pivot holes of the two side plates, the second lugs are pivotably connected with the pivotal plates.

3. The system as claimed in claim 1, wherein the end member has a rubber piece on a top thereof.

4. The system as claimed in claim 1, wherein the threaded rod of the adjusting unit has a plain section which is connected to the end member, and a threaded section which extends out from the end member, a knob is threadedly connected to the threaded section.

5. The system as claimed in claim 1, wherein each of the side portions has a protrusion extending axially from a distal end thereof, the protrusions extend through the pivotal plate and the slots and are connected with an end cap, the end caps are fixed to the protrusions by two locking members so that the two end caps are movable in the slots.

6. An exerciser comprising:

a base having an upright frame on a front end thereof, a fly wheel located between the base and the upright frame, two rail units connected to a rear end of the base and two links connected between the fly wheel and the rail units, the links connected to two pedal units and being movable alternatively;

each pedal unit having a casing having an end member and two side plates which are connected on two ends of the end member, each of the two side plates having a slot defined therethrough;

an adjusting unit having a tubular body which has a nut connected to an end thereof, a threaded rod threadedly extending through the tubular body and the nut, the tubular body having two side portions which are movably engaged with the two slots of the two side plates, two pivotal plates each having an end connected to the side portion corresponding thereto;

a pivotable unit having a first end pivotably connected to the two side plats and a second end of the pivotable unit pivotably connected to the two pivotal plates, and a pedal connected on the pivotable unit.

7. The exerciser as claimed in claim 6, wherein two handles and swing arms are pivotably connected on two sides of the upright frame, two respective connection rods connected between the two pedal units and two respective lower ends of the two swing arms, each connection rod has a connection section which is connected to the pedal unit corresponding thereto, two side plates of the casing each have a first hole through which the connection section extends.

8. The exerciser as claimed in claim 6, wherein each link has a connection member at a mediate portion thereof and the connection member has a tube, the two side plates of the casing each have a second hole, a pin extends through the tube and are connected with two end members on two ends thereof, the two end members are connected to the two respective second holes by two locking members.

9. The exerciser as claimed in claim 6, wherein the pivotable unit includes a bottom board which has two first lugs extending from an underside of the first end thereof and two second lugs extend from the underside of the second end of the bottom board, the two side plates each have a pivot hole and the first lugs are connected with the pivot holes of the two side plates, the second lugs are pivotably connected with the pivotal plates.

10. The exerciser as claimed in claim 6, wherein the end member has a rubber piece on a top thereof.

11. The exerciser as claimed in claim 6, wherein the threaded rod of the adjusting unit has a plain section which is connected to the end member, and a threaded section which extends out from the end member, a knob is threadedly connected to the threaded section.

12. The exerciser as claimed in claim 6, wherein each of the side portions has a protrusion extending axially from a distal end thereof, the protrusions extend through the pivotal plate and the slots and are connected with an end cap, the end caps are fixed to the protrusions by two locking members so that the two end caps are movable in the slots.

* * * * *